US005350529A

United States Patent [19]

Day

[11] Patent Number: 5,350,529

[45] Date of Patent: Sep. 27, 1994

[54] LOW FUME FINISH FOR WET AIR-JET TEXTURING

[75] Inventor: Fleming H. Day, Greenville, N.C.

[73] Assignee: E. I. Du Pont du Nemours and Company, Wilmington, Del.

[21] Appl. No.: 937,253

[22] Filed: Aug. 28, 1992

[51] Int. Cl.[5] ..... D06M 15/53

[52] U.S. Cl. ..... 252/8.6; 252/8.90; 252/DIG. 1; 252/51.5 A; 252/56; 8/115.62; 428/290

[58] Field of Search ..... 252/8.6, 8.7, 8.8, 8.9, 252/DIG. 1, 51.5 A, 52.5 A; 8/11.16; 428/290

[56] References Cited

U.S. PATENT DOCUMENTS

| | | | |
|---|---|---|---|
| 3,954,631 | 5/1976 | Marshall et al. | 252/8.7 |
| 3,997,450 | 12/1976 | Steinmiller | 252/8.7 |
| 4,283,292 | 8/1981 | Marshall et al. | 252/8.8 |
| 4,438,001 | 3/1984 | Suzuki et al. | 252/8.8 |
| 4,505,956 | 3/1985 | Yamamoto et al. | 252/8.8 |
| 4,800,117 | 1/1989 | Marshall | 252/8.8 |
| 4,929,366 | 5/1990 | Yamamoto et al. | 252/8.7 |
| 4,995,884 | 2/1991 | Ross et al. | 252/8.8 |

OTHER PUBLICATIONS

Research Disclosure 16908—May 1978.
Research Disclosure 118119—May 1979.
Research Disclosure 18404—Aug. 1979.

*Primary Examiner*—Paul Lieberman
*Assistant Examiner*—Michael P. Tierney

[57] ABSTRACT

A lubricating finish composition suitable for application as a water emulsion to synthetic filaments and synthetic filaments coated with the composition. The composition of the invention comprises:

about 60 to about 98.9 weight percent nonionic emulsifier having a melting point less than about 25° C.;

about 1 to about 39.9 weight percent lubricant having at least 29 carbon atoms and a melting point less than about 25° C.; and about 0.1 to about 15 weight percent anionic surfactant.

15 Claims, No Drawings

LOW FUME FINISH FOR WET AIR-JET TEXTURING

BACKGROUND OF THE INVENTION

The present invention relates to finish compositions for use with synthetic filaments and relates more particularly to low fume finish compositions suitable for wet air-jet texturing and synthetic filaments coated with such compositions.

Synthetic fiber producers provide the textile industry with a wide variety of continuous filament yarn products. These differ in polymer type, orientation, denier, denier per filament, luster, cross-section, dyeability, and other distinguishing properties. Many of these commercially available yarns would otherwise be desirable as feed yarns for air-jet texturing but they contain conventional finish compositions developed for other kinds of processing such as false-twist texturing, weaving, and knitting.

Unfortunately, yarns with conventional finish compositions are not well-suited for the special needs of wet air-jet texturing so they can cause serious quality and productivity problems. Critical among these is the build-up of deposits in the air-bulking jet. The build-up of deposits initially reduces bulk level and bulk uniformity, reduces threadline tension uniformity, and ultimately causes threadline breaks and stringup difficulty. Conventional finishes when used on yarns for wet air-jet texturing also cause environmental and occupational health problems in hot processing during yarn manufacture by releasing vapor and aerosol fumes into the workplace and the environment.

SUMMARY OF INVENTION

The invention provides a lubricating finish composition and synthetic filaments coated with the composition. The composition of the invention comprises:

about 60 to about 98.9, preferably 65 to about 95, weight percent nonionic emulsifier having a melting point less than about 25° C.;

about 1 to about 39.9 weight percent lubricant having at least 29 carbon atoms and a melting point less than about 25° C.; and about 0.1 to about 15 weight percent anionic surfactant.

Preferably, the finish composition has an acid value of less than about 8, most preferably less than about 4.

In a preferred form of the invention, the nonionic emulsifier is selected from the class consisting of polyoxyalkylene condensation products having a lipophilic portion derived from an alcohol or a carboxylic acid. Most preferably, the polyoxyalkylene condensation products are of natural and synthetic aliphatic monohydric alcohols and natural and synthetic aliphatic monobasic carboxylic acids with a number average molecule weight of at least about 600 amu. The lubricant is preferably selected from the class consisting of natural and synthetic esters having a number average molecular weight of at least about 450 amu.

In a preferred form of the invention, the anionic surfactant is selected from the group consisting of alkali metal salts of a sulfonated dicarboxylic acid ester, preferably an alkali metal salt of a dialkyl sulfosuccinic acid such as sodium di-2-ethylhexyl sulfosuccinate or potassium di-2-ethylhexyl sulfosuccinate.

Preferably, the finish composition comprises a stabilizer in the amount of about 0.05 to 5 weight percent, most preferably, about 0.05 to 1 weight percent.

The finish composition is advantageously applied as a water emulsion to synthetic filaments preferably polyamide and polyester multifilament yarns. The finish composition is especially useful when such yarns are for use in wet air-jet texturing.

DETAILED DESCRIPTION

The finish composition in accordance with the invention includes about 60 to about 98.9 weight percent nonionic emulsifier, preferably 65 to about 95 weight percent nonionic emulsifier. The nonionic emulsifier should have a suitable Hydrophile-Lipophile Balance (HLB) to impart water emulsifiability to the finish composition and should exhibit low fuming. The nonionic emulsifier is one or a mixture of nonionic emulsifiers which are liquid at temperatures less than 25° C. so that this component will not solidify at ambient temperatures and be prone to form deposits on a texturing jet when a yarn with the finish is used in a wet air-jet texturing process.

Preferably, the nonionic emulsifier is selected from the class consisting of polyoxyalkylene condensation products having a lipophilic portion derived from an alcohol or a carboxylic acid. Most preferably, the polyoxyalkylene condensation products are of natural and synthetic aliphatic monohydric alcohols and natural and synthetic aliphatic monobasic carboxylic acids. It is also preferred for the nonionic emulsifier to have a number average molecule weight of at least about 600 atomic mass units (amu). The hydrophilic portion of the preferred nonionic emulsifier should be composed primarily of repeating oxyethylene units but some higher alkylene oxide units may be incorporated into the polyoxyalkylene chain segments to provide liquidity at temperatures less than 25° C. The lipophilic portion of the preferred nonionic emulsifier can be derived from fatty acid, fatty acid esters, or fatty alcohols or may be derived from suitable synthetic aliphatic monobasic carboxylic acids or esters or synthetic aliphatic monohydric alcohols. To provide liquidity at temperatures less than 25° C., these lipophilic portions preferably incorporate short hydrocarbon chains usually less than 12 carbons or, if approaching or exceeding 12 carbon atoms, this portion should have at least some chain branching or unsaturation. However, the degree of unsaturation should be sufficiently low that the nonionic emulsifier is not prone to oxidative degradation, especially varnishing during high temperature processing.

The finish composition also includes about I to about 39.9 weight percent lubricant with a melting point less than 25° C. The lubricant should be a lubricant or mixture of lubricants which resists fuming on hot machine parts during spinning of yarns or in subsequent processing. Preferably, the lubricant is selected from the class consisting of natural and synthetic esters with a number average molecular weight of at least 450 amu. The lubricants used should contain short hydrocarbon chains of less than 12 carbons or, if more than 12 carbon atoms, should have at least some chain branching or unsaturation to provide liquidity at temperatures less than 25° C. However, for resistance to oxidative degradation, especially varnishing during high temperature processing, the lubricant should be low in unsaturation. Preferably, unsaturation as measured by iodine value is less than about 100. For finishes intended for use when greater thermal-oxidative stability is required, e.g., processing temperatures of 150° C. or above, the iodine value is preferably less than 10. Examples of suitable esters include mono-, di-, and polyesters such as pentaerythritol tetrapelargonate, tridecyl stearate, ditridecyl adipate, and neopentyl glycol dioleate.

The finish composition also includes about 0.1% to about 15 weight percent anionic surfactant. The anionic surfactant should be selected to work well with the particular nonionic emulsifier or mixture of nonionic emulsifiers used in the composition for increased emulsifiability, enhanced wetting properties and keeping the texturing jet free of harmful deposit build-up. Preferably, anionic surfactant is selected from the group consisting of alkali metal salts of a sulfonated dicarboxylic acid ester. Most preferably, the anionic surfactant is selected from the group consisting of alkali metal salts of a dialkyl sulfosuccinic acid such as sodium di-2-ethylhexl sulfosuccinate or potassium di-2-ethylhexyl sulfosuccinate.

The finish composition preferably includes a stabilizer in the amount of about 0.05 to 5 weight percent, most preferably 0.05 to 1 weight percent, to provide additional thermal-oxidative stability. The stabilizer can be a single compound such as an antioxidant or can be a stabilizer package containing an antioxidant together with additional materials for the purpose of enhancing oxidative stability. Provided that they enhance finish properties, any of a wide variety of stabilizers known for use in finishes can be used in a finish in accordance with the present invention. An example of a stabilizer advantageously used in accordance with the present invention is the stabilizer trilauryl phosphite. When trilauryl phosphite is used as the stabilizer, an inorganic base such as potassium hydroxide preferably is added to adjust the pH to greater than about 7 which imparts additional stability to the finish.

The finish compositions provide improved performance in wet air-jet texturing and are less prone to form deposits on the jet when they do not contain substantial quantities of free carboxylic acids. Preferably, the finish compositions have an acid value of less than about 8, most preferably less than about 4, when measured on the finish mixture before addition of alkaline materials optionally added for stabilization.

The finish composition in accordance with the invention is conveniently used as a water emulsion to coat synthetic filaments. Depending on the specific components of the finish, stable water emulsions with a wide range of compositions are possible. Typically, emulsions in which the finish composition constitutes about 0.1 weight percent to about 30 weight percent are used. While the finish has a number of potentially beneficial applications, the finish is well-suited for use as a "spin finish" when applied to an as-spun multifilament yarn and is also suited for use as a secondary finish when applied either before or after drawing. The finish may be applied by any of a variety of known methods for applying emulsion finishes such as using a rotating roll or metering tip applicator. The finish composition is preferably applied at a temperature of about 5 ° C. to about 95° C., most preferably, about 20° C. to about 70° C. Preferably, the amount of finish applied to the synthetic filament is such that about 0.2 to 2.0 weight percent of the composition remains on the yarn after the water has evaporated (hereinafter referred to as "finish on yarn" or "FOY").

The finish is preferably used with filaments of a polymer selected from the class consisting of polyamide homopolymers and copolymers and polyester homopolymers and copolymers. The finish provides particular advantage when the finish is applied to a yarn to be used in wet air-jet texturing processes including those texturing a single yarn or multiple yarns entering the jet at the same or different speeds. Finish build-up on the jet is substantially decreased compared to conventional finishes including commercially-available polyether based finishes thereby providing uniform texturing and low break levels. Preferred finish compositions also provide high bulking efficiency needed to provide high speed wet air-jet texturing, bulk uniformity, and high levels of bulk. The yarns so textured also exhibit improved bulk retention and high strength in the yarns and fabrics of the yarns. Moreover, preferred finish compositions which contain stabilizers provide improved thermal-oxidative stability and very low fuming in hot processing.

TEST METHODS

Iodine Value (AOCS Method Cd 1-25) is determined by the Wijs method and expressed as the number of centigrams of iodine absorbed per gram of lubricant.

Viscosity is measured with a viscometer sold under the trademark BROOKFIELD® SYNCHRO-LECTRIC by Brookfield Engineering Laboratories, Inc., Stoughton, Mass.

pH is measured as a 5 weight percent dispersion in demineralized water using a pH meter.

% Varnish—Thin Film Oven Test—Several replicates of test finishes are prepared by precisely weighing 0.30–0.35 grams of finish into previously weighed 57 mm aluminum weigh dishes. These dishes are randomly placed into 16"×9"×2" (41 cm×23 cm×5 cm) porcelain coated steel trays and placed in an electrically heated forced air oven. After heating at 215° C. for 16 hours, the trays are removed and allowed to cool to room temperature before re-weighing the aluminum weigh dishes with finish residue. Then 10–20 grams of acetone are added to the weigh dishes to remove soluble residue. After standing for 10 minutes, the acetone is poured out of the weigh dish and any remaining acetone soluble residue is removed by rinsing with a stream of acetone from a squeeze bottle. The aluminum dishes are dried about 10 minutes in a 75° C. oven and cooled to room temperature before a final weighing of aluminum dishes to determine the percentage of acetone-insoluble varnish based on the original sample weight.

Acid Value is defined as the number of milligrams of potassium hydroxide required to neutralize the free fatty acids in one gram of sample. If potassium hydroxide or other inorganic base is used in the finish for stabilization or other purposes, acid value is measured without the addition of such inorganic base to the finish. Alternately, the acid value of the components can be measured and the results used to calculate the acid value for the finish.

EXAMPLE 1

Example finishes A and B with the compositions listed in Table I are prepared by charging a mechanically stirred vessel with the components in the order from top to bottom as listed in Table I. After adding the KOH slowly as a 45% water solution, the mixture is stirred an additional 5 minutes to assure complete mixing prior to adding the ester lubricant.

The finishes are subjected to test procedures to predict performance in use and the results are reported in Table II.

TABLE I

| | FINISH A | FINISH B |
|---|---|---|
| POE (14) Isostearate | 66.4 | 71.4 |
| Sodium Di-2-Ethylhexyl Sulfosuccinate | 3.0 | 3.0 |
| (75 wt. % Conc.) | (4.0) | (4.0) |
| Trilauryl Phosphite | 0.5 | 0.5 |
| KOH | 0.1 | 0.1 |
| (45 wt % Conc.) | (.22) | (.22) |
| Tridecyl Stearate | 30.0 | 0.0 |
| Pentaerythritol Tetrapelargonate | 0.0 | 25.0 |

TABLE II

| | FINISH A | FINISH B |
|---|---|---|
| Oven Test-16 Hr. @ 215° C. | | |
| % Residue | 6.1 | 13.0 |
| % Varnish | 5.5 | 9.6 |
| Smoke Point, ° C. | 144 | 157 |
| Viscosity @ 75° C. | 20.6 | 22.7 |

EXAMPLE 2

Example finishes A and B are used as a finish for 70 denier, 34 filament nylon 66 yarn for a wet air-jet texturing evaluation. A coupled spin-draw process with a wind-up speed of 3500 yards per minute (3200 meters per minute) is used for making the yarns from 52 RV polymer containing 0.02 weight percent $TiO_2$. A primary finish is applied to the yarn before drawing from an about 3.5 weight percent water emulsion and a secondary finish is also applied using a similar emulsion before wind-up.

Wet air-jet texturing is done on a Reiter-Scragg Jetex 1200 machine using Heberlein air-texturing jets with 135 psi air and a 230° C. vapor phase setting heater. The 2-ply parallel texturing test at 325 meter/minute was run four days with four positions per item. Feed yarn properties, textured yarn properties, and positional stops data are presented in Table III. Positional stops occur when the yarn breaks in the jet or the process must be stopped such as when the threadline becomes unstable indicating non-uniform texturing which requires the jet to be cleaned or changed.

TABLE III

| | FINISH A | FINISH B |
|---|---|---|
| Feed Yarn | | |
| Tenacity, g/den. | 6.34 | 6.24 |
| Elongation to Break, % | 33.4 | 32.6 |
| FOY | 0.71 | 0.76 |
| 2-Ply Parallel Texturing | | |
| Denier | 157.4 | 157.4 |
| Tenacity, g/den. | 5.04 | 4.84 |
| Positional Stops/Day | 0.50 | 0.69 |

I claim:

1. A lubricating finish composition comprising:

65 to about 98.9 weight percent nonionic emulsifier selected from the class consisting of polyoxyalkylene condensation products having a lipophilic portion derived from an alcohol or a carboxylic acid, said emulsifier having a number average molecular weight of at least about 600 amu and a melting point less than about 25° C.;

about 1 to about 39.9 weight percent lubricant selected from the class consisting of natural and synthetic esters having a number average molecular weight of at least about 450 amu, said lubricant having at least 29 carbon atoms and a melting point less than 25° C.; and 0.1 to about 15 weight percent anionic surfactant selected from the class consisting of alkali metal salts of a sulfonated dicarboxylic acid ester.

2. The finish composition of claim 1 wherein said finish composition has an acid value of less than about 8.

3. The finish composition of claim 1 wherein said finish composition has an acid value of less than about 4.

4. The finish composition of claim 1 wherein said composition comprises 65 to about 95 weight percent of said nonionic emulsifier.

5. The finish composition of claim 1 wherein said nonionic emulsifier is selected from the class consisting of polyoxyalkylene condensation products of natural and synthetic aliphatic monohydric alcohols and natural and synthetic aliphatic monobasic carboxylic acids.

6. The finish composition of claim 1 wherein said anionic surfactant is selected from the group consisting of alkali metal salts of a dialkyl sulfosuccinic acid.

7. The finish composition of claim 9 wherein said anionic surfactant is selected from the class consisting of sodium di-2-ethylhexyl sulfosuccinate and potassium di-2-ethylhexyl sulfosuccinate.

8. A synthetic filament coated with a finish composition comprising:

65 to about 98.9 weight percent nonionic emulsifier selected from the class consisting of polyoxyalkylene condensation products having a lipophilic portion derived from an alcohol or a carboxylic acid, said emulsifier having a melting point less than about 25° C.;

about 1 to about 39.9 weight percent lubricant selected from the class consisting of natural and synthetic esters having a number average molecular weight of at least about 450 amu, said lubricant having at least 29 carbon atoms and a melting point less than 25° C.; and 0.1 to about 15 weight percent anionic surfactant selected from the class consisting of alkali metal salts of a sulfonated dicarboxylic acid ester.

9. The synthetic filament of claim 1 wherein said finish composition has an acid value of less than about 8.

10. The synthetic filament of claim 9 wherein said finish composition has an acid value of less than about 4.

11. The synthetic filament of claim 8 wherein said composition comprises 65 to about 95 weight percent of said nonionic emulsifier.

12. The synthetic filament of claim 8 wherein said nonionic emulsifier is selected from the class consisting of polyoxyalkylene condensation products of natural and synthetic aliphatic monohydric alcohols and natural and synthetic aliphatic monobasic carboxylic acids.

13. The synthetic filament of claim 8 wherein said anionic surfactant is selected from the group consisting of alkali metal salts of a dialkyl sulfosuccinic acid.

14. The synthetic filament of claim 13 wherein said anionic surfactant is selected from the class consisting of sodium di-2-ethylhexyl sulfosuccinate and potassium di-2-ethylhexyl sulfosuccinate.

15. The synthetic filament of claim 8 wherein said filament is comprised of a polymer selected from the class consisting of polyamide homopolymers and copolymers and polyester homopolymers and copolymers.

* * * * *